US005167179A

United States Patent [19]

Yamauchi et al.

[11] Patent Number: 5,167,179

[45] Date of Patent: Dec. 1, 1992

[54] ELECTRONIC MUSICAL INSTRUMENT FOR SIMULATING A STRINGED INSTRUMENT

[75] Inventors: Akira Yamauchi; Masahiro Shimizu, both of Hamamatsu, Japan

[73] Assignee: Yamaha Corporation, Hamamatsu, Japan

[21] Appl. No.: 742,840

[22] Filed: Aug. 8, 1991

[30] Foreign Application Priority Data

Aug. 10, 1990 [JP] Japan ..... 2-212720
Aug. 10, 1990 [JP] Japan ..... 2-212721

[51] Int. Cl.[5] ..... G10H 1/22

[52] U.S. Cl. ..... 84/618; 84/621; 84/646; 84/722; 84/656

[58] Field of Search ..... 84/617, 618, 646, 722, 84/DIG. 30, 621, 656

[56] References Cited

U.S. PATENT DOCUMENTS

| | | | |
|---|---|---|---|
| 4,703,680 | 11/1987 | Wachi et al. | 84/615 |
| 4,711,148 | 12/1987 | Takeda et al. | 84/453 X |
| 4,791,848 | 12/1988 | Blum, Jr. | 84/453 |
| 4,920,851 | 5/1990 | Abe | 84/626 |
| 4,922,796 | 5/1990 | Kondo et al. | 84/618 |
| 4,932,304 | 6/1990 | Franzmann | 84/671 |
| 4,986,157 | 1/1991 | Matsubara | 84/646 |

FOREIGN PATENT DOCUMENTS 0248527 4/1987 European Pat. Off. .

*Primary Examiner*—William M. Shoop, Jr.
*Assistant Examiner*—Brian Sircus
*Attorney, Agent, or Firm*—Graham & James

[57] ABSTRACT

In order to accurately simulate the sounding system of the stringed instrument such as the violin and cello, an electronic musical instrument provides a performance unit such as a keyboard and a multi-channel sound source unit. As the sound source unit, there is provided a plurality of string sound generating circuits, each corresponding to each of plural strings provided in the stringed instrument, each of which forms a musical tone waveform signal having a different tone color. When performance information is created by operating the performance unit, one of the string sound generating circuits and its fingering position is selected on the basis of the preceding tone-generation assignment state, and then tone-generation corresponding to the created performance information is assigned to the selected circuit. Normally, plural musical tones can be sounded simultaneously in the stringed instrument. However, due to the restriction of the performance which must be inevitably occurred when playing the actual stringed instrument, there is established a restriction condition for the simultaneous tone-generation operation.

12 Claims, 20 Drawing Sheets

| \ POSITION | 0 | 1 | 2 | 3 | 4 | 5 | 6 | 7 | 8 · · · 23 |
|---|---|---|---|---|---|---|---|---|---|
| 1ST STRING | 57 | 58 | 59 | 60 | 61 | 62 | 63 | 64 | 65 · · · 80 |
| 2ND STRING | 50 | 51 | 52 | 53 | 54 | 55 | 56 | 57 | 58 · · · |
| 3RD STRING | 43 | 44 | 45 | 46 | 47 | 48 | 49 | 50 | 51 · · · |
| 4TH STRING | 36 | 37 | 38 | 39 | 40 | 41 | 42 | 43 | 44 · · · |

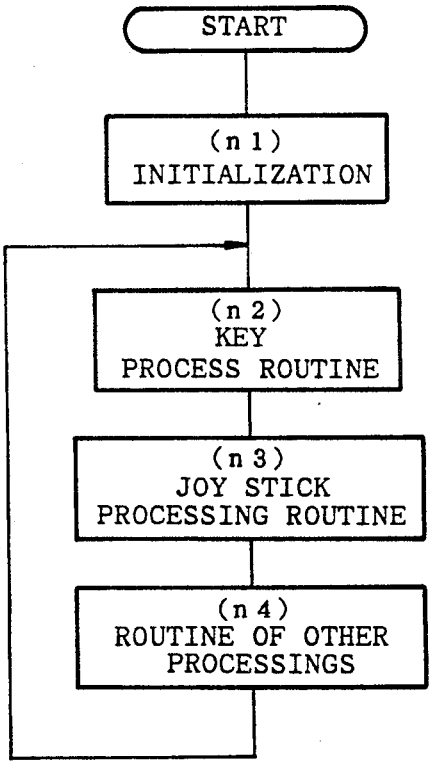
FIG.9 (MAIN ROUTINE)
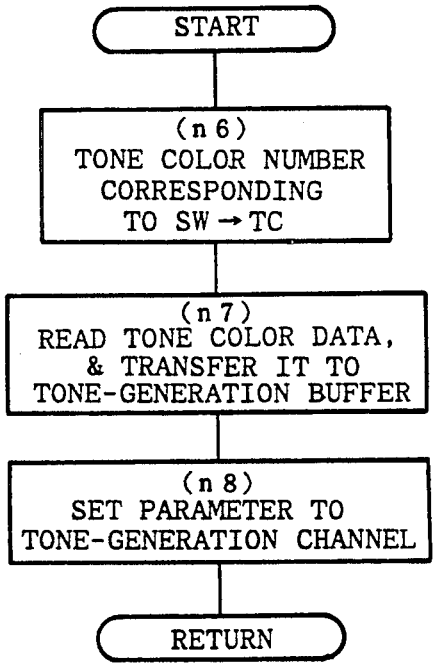
FIG.10 (TONE COLOR SW ON-EVENT ROUTINE)

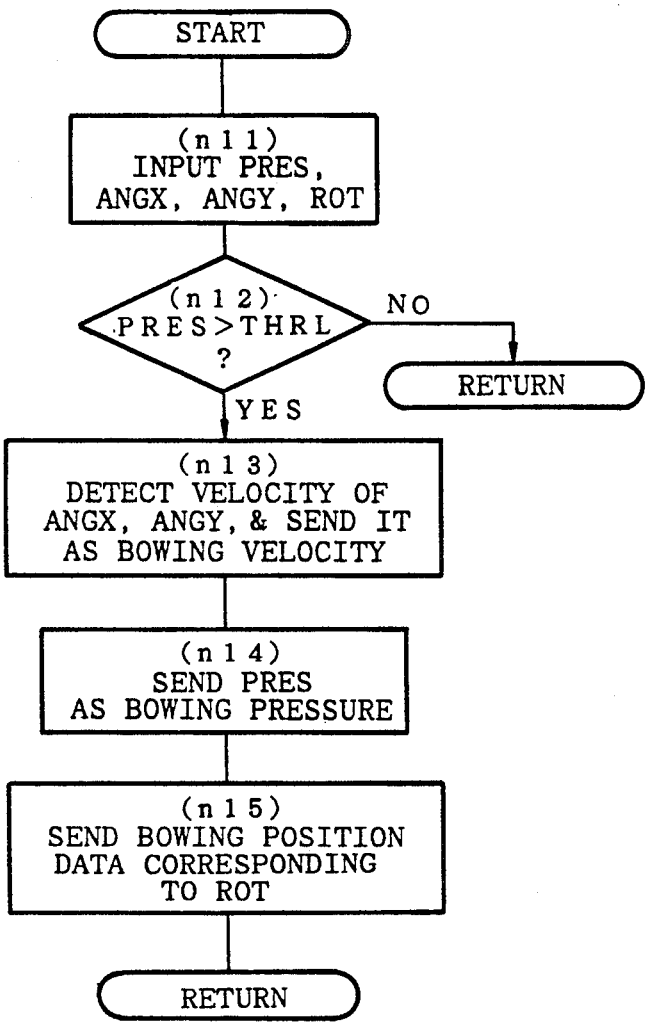
FIG. 11 (JOY STICK PROCESSING ROUTINE)

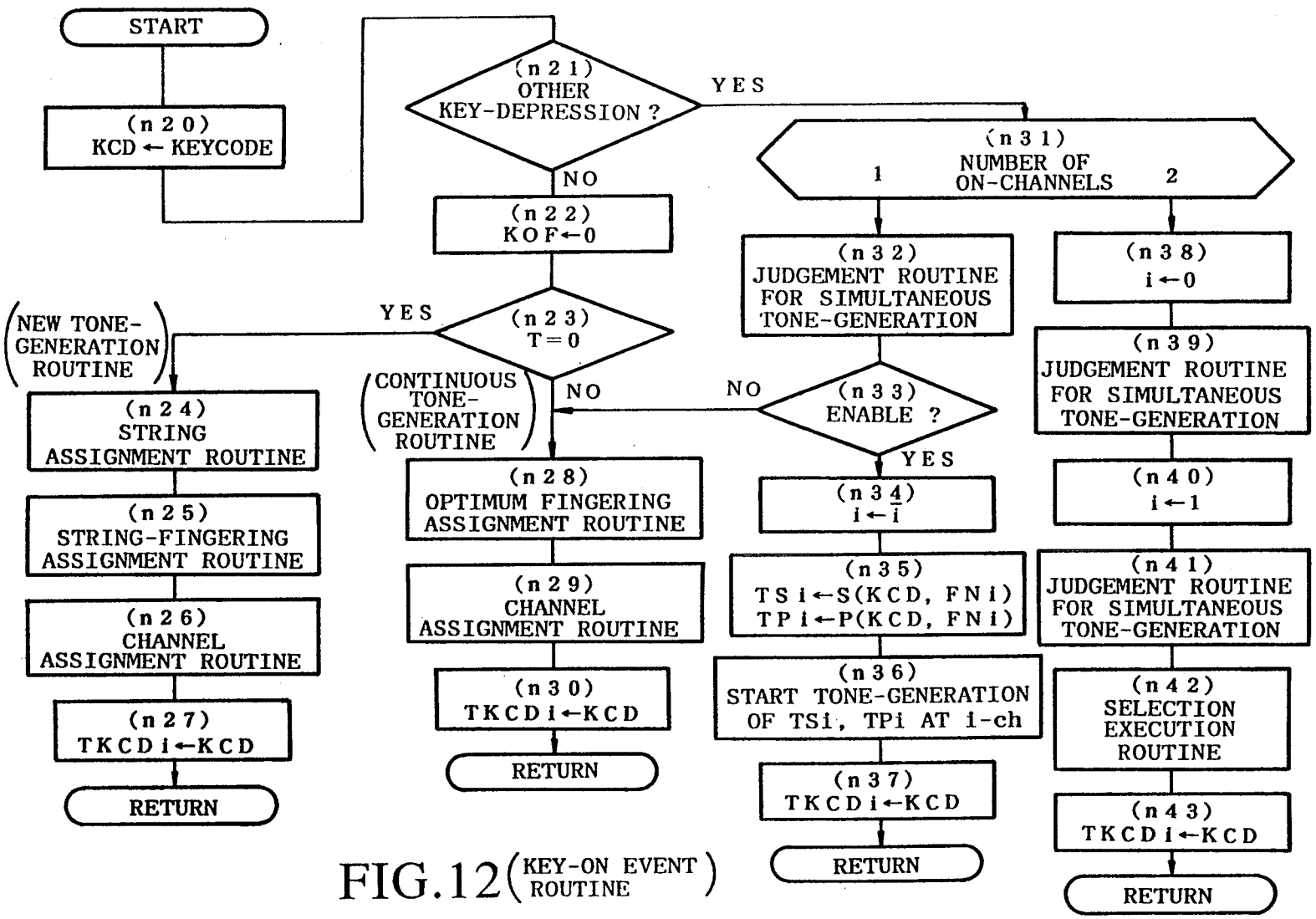
FIG. 12 (KEY-ON EVENT ROUTINE)

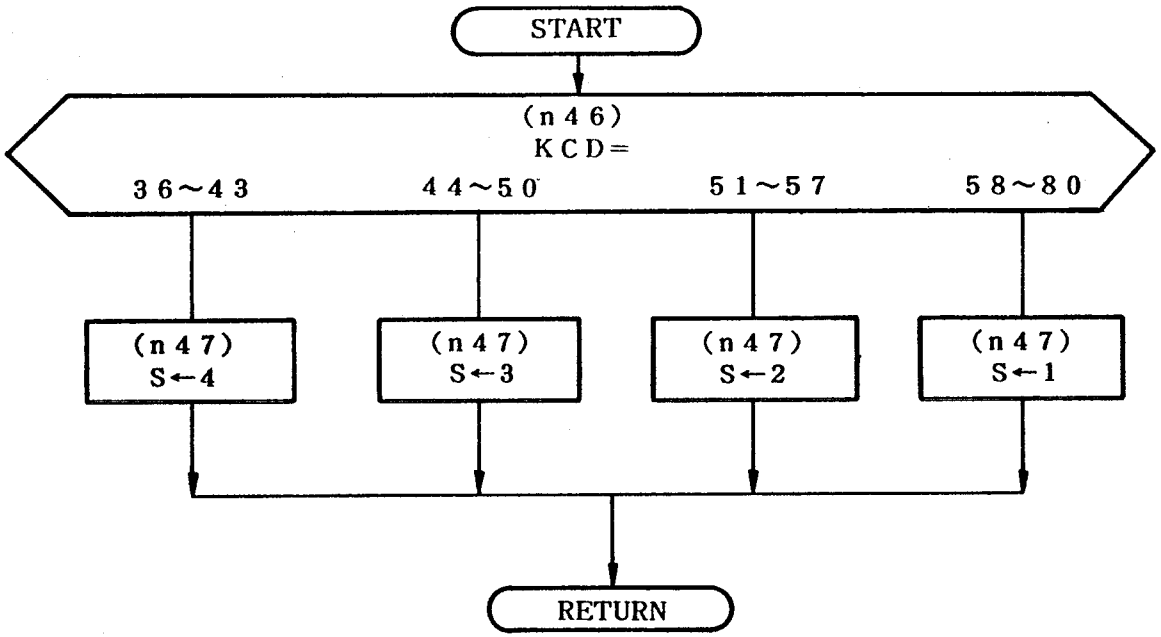
FIG. 13 ( STRING ASSIGNMENT ROUTINE )

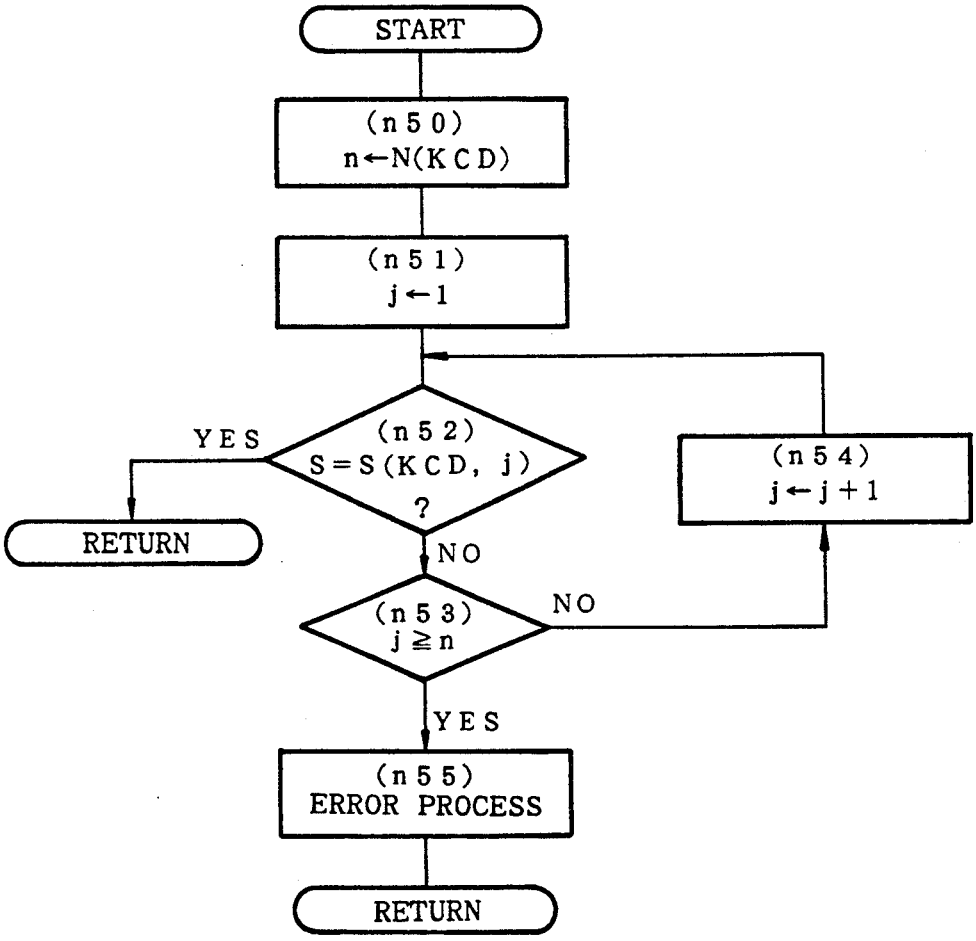
FIG. 14 ( STRING-FINGERING ASSIGNMENT ROUTINE )

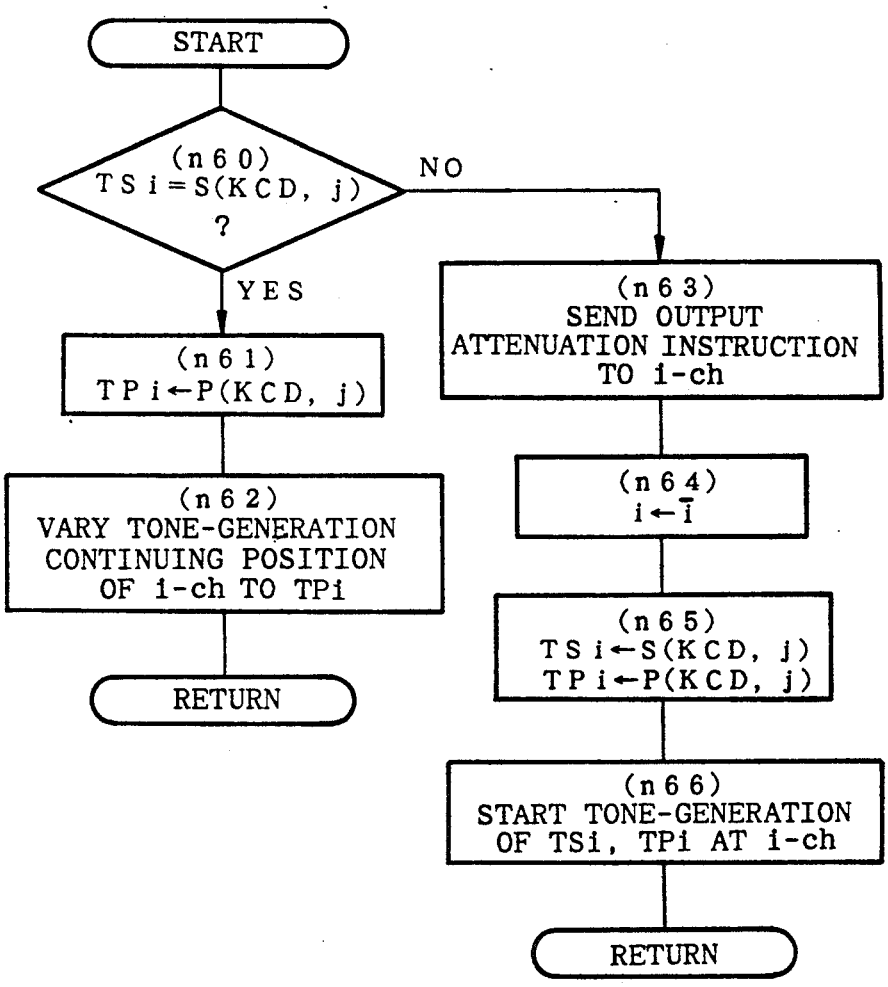
FIG.15 (CHANNEL ASSIGNMENT ROUTINE)

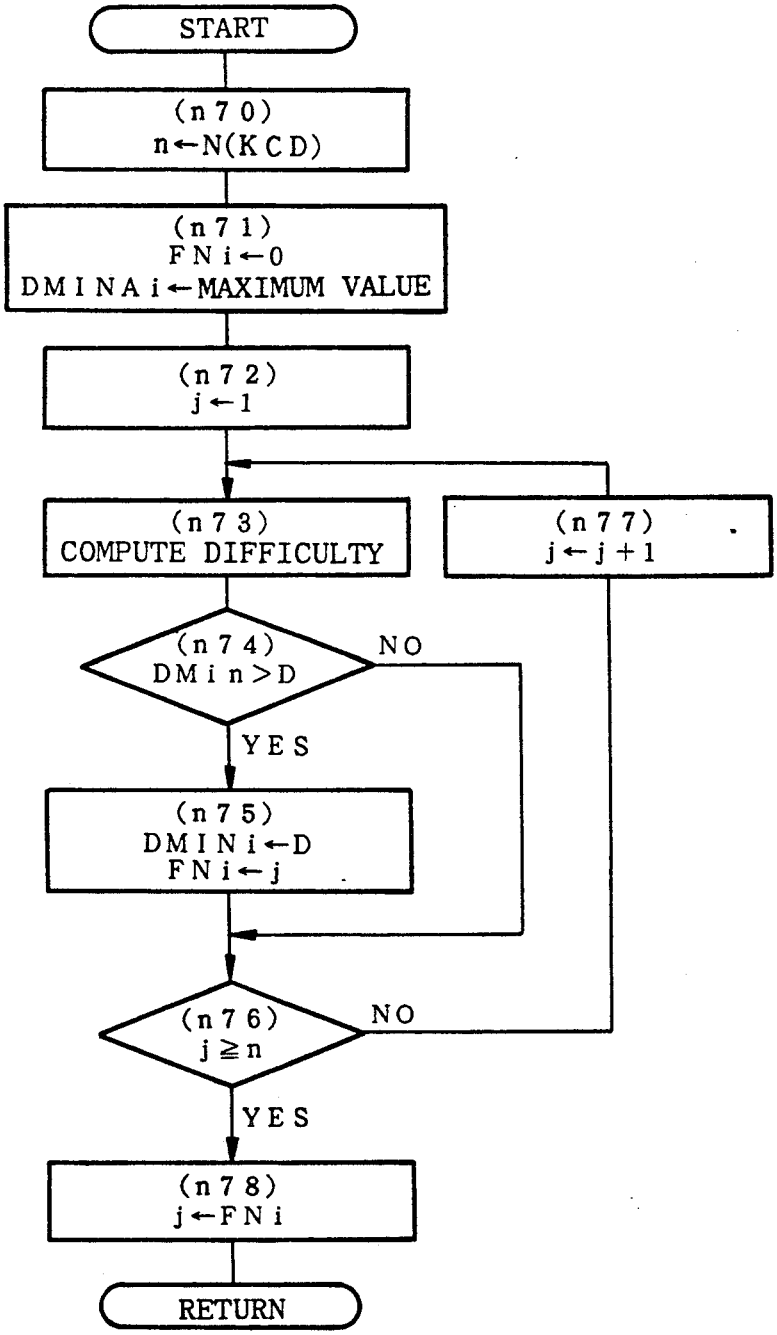
FIG.16 (OPTIMUM FINGERING ASSIGNMENT ROUTINE)

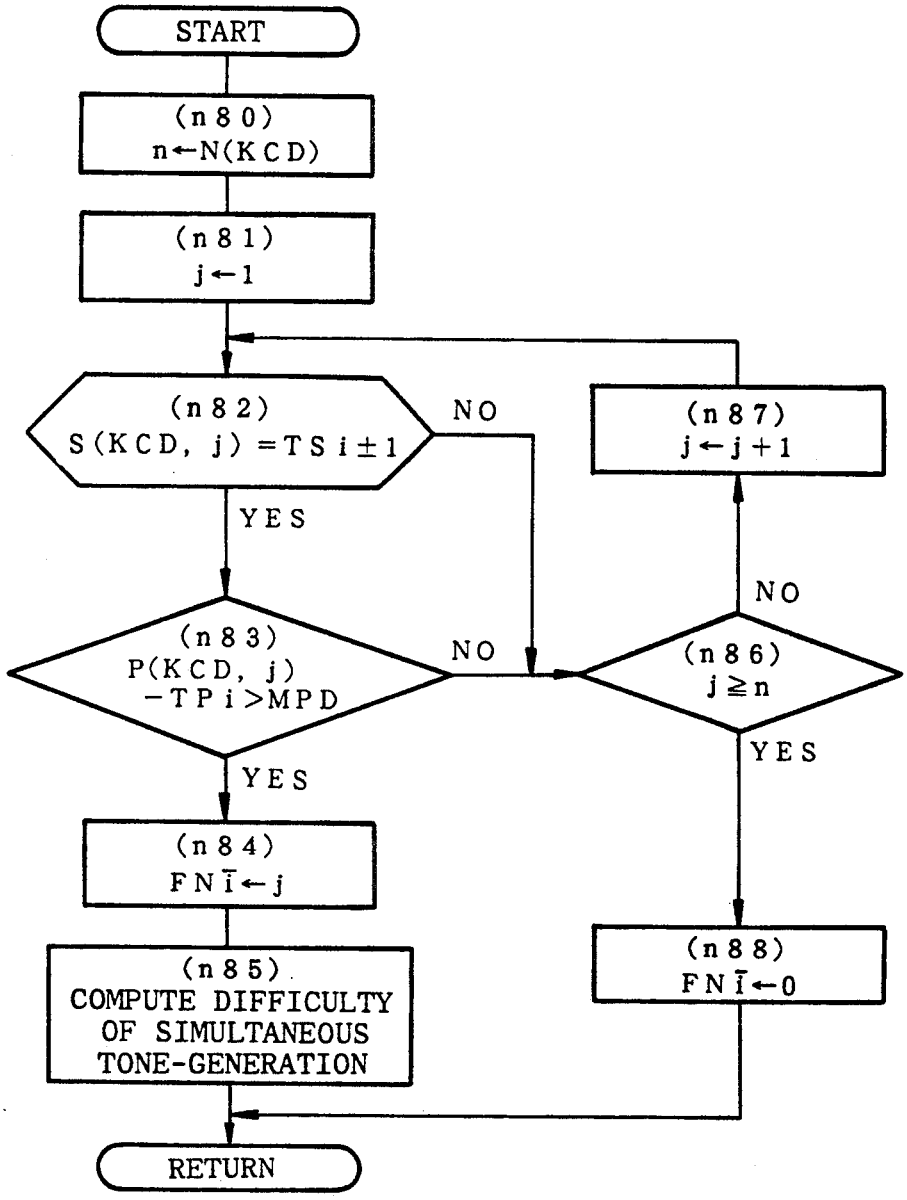
FIG.17 (JUDGEMENT ROUTINE FOR SIMULTANEOUS TONE-GENERATION)

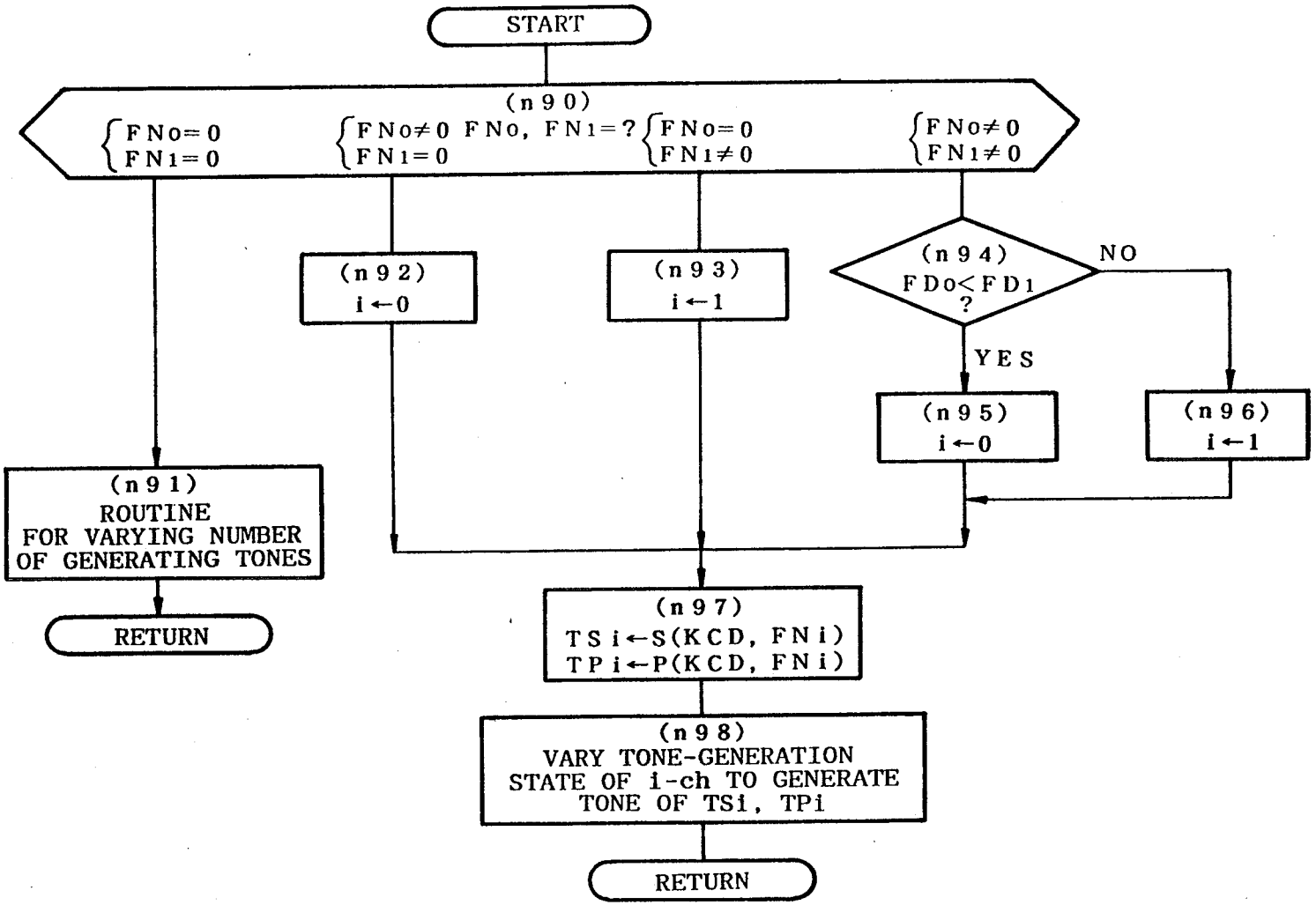
FIG. 18 (SELECTION EXECUTION ROUTINE)

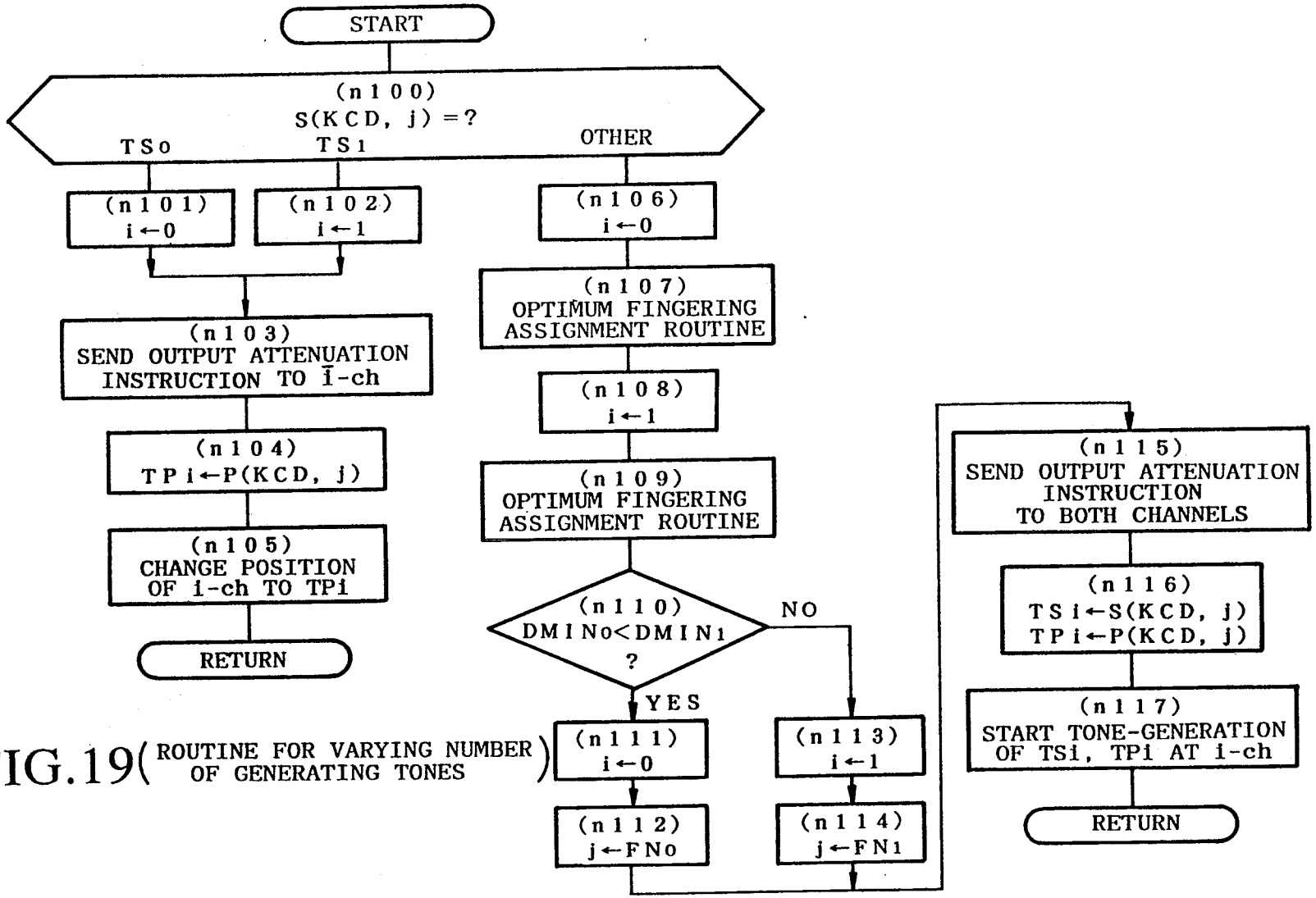
FIG. 19 (ROUTINE FOR VARYING NUMBER OF GENERATING TONES)

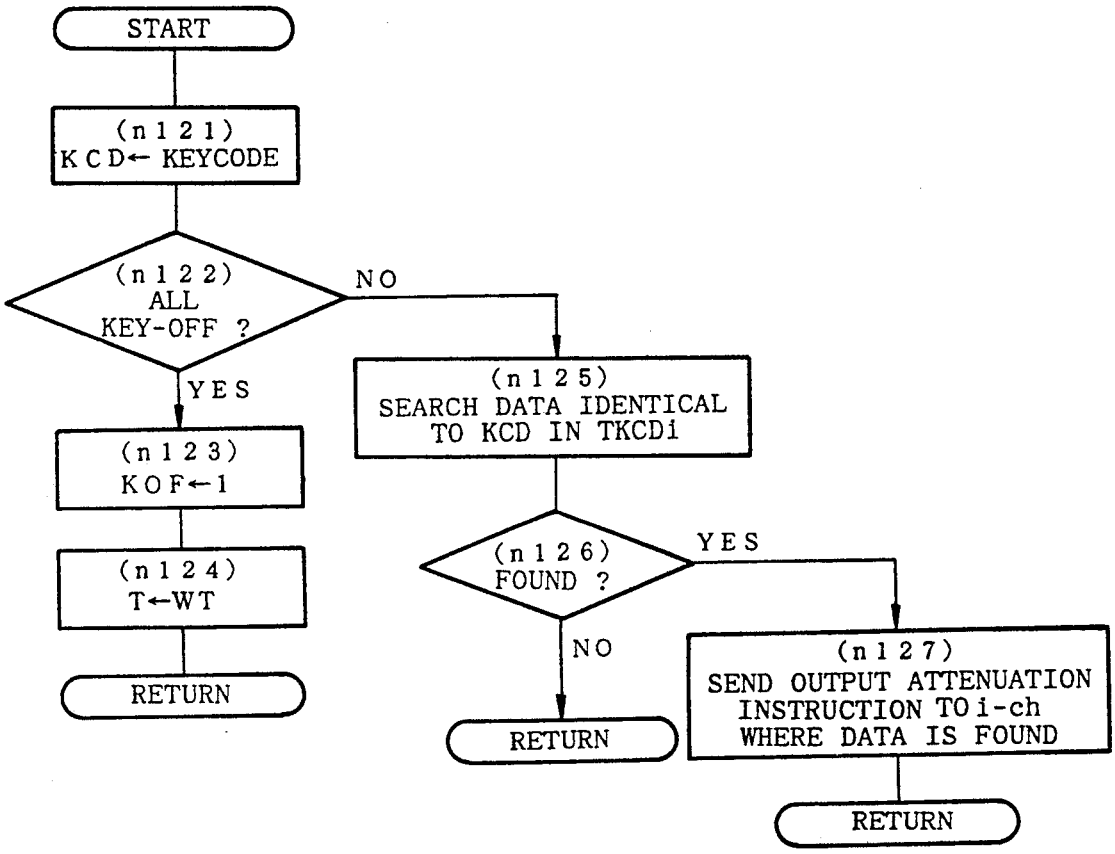
FIG.20 (KEY-OFF EVENT ROUTINE)

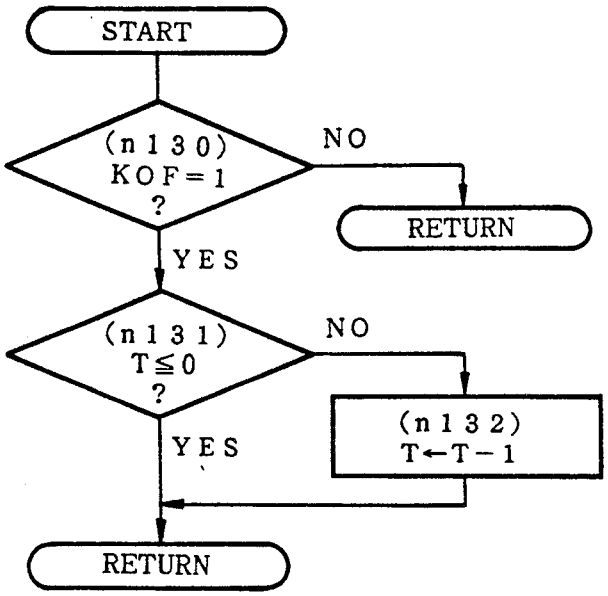
FIG.21 (TIMER INTERRUPT ROUTINE)

ELECTRONIC MUSICAL INSTRUMENT FOR SIMULATING A STRINGED INSTRUMENT

BACKGROUND OF THE INVENTION

1. Field of the Invention

The present invention relates to an electronic musical instrument providing a sounding system similar to that of a non-electronic stringed instrument.

2. Prior Art

Conventionally, the electronic musical instrument provides a performance unit and a sound source unit. Herein, performance information is created when performing the performance unit, and then it is inputted into the sound source unit. On the basis of the performance information, the sound source unit controls the pitch or tone color of the musical tone to be generated.

In most case, the conventional electronic musical instrument provides a keyboard as the above-mentioned performance unit. Therefore, the performance information, to be generated by operating the keyboard, must be suitable to express the performance state of the keyboard instrument. For this reason, the sound source unit is also designed to form the musical tone waveform signal based on such performance information.

Thus, the conventional performance unit cannot adequately express the performance state of the other instruments such as the stringed instrument. In addition, the conventional sound source unit cannot adequately form the musical tone waveform signal for the stringed instrument and the like.

SUMMARY OF THE INVENTION

It is accordingly a primary object of the present invention to provide an electronic musical instrument which can simulate the sounding system of the stringed instrument.

In a first aspect of the present invention, there is provided an electronic musical instrument which simulates a sounding system of a stringed-instrument, comprising:

a plurality of string sound generating means each forming a musical tone waveform signal having a different tone color;

performance information creating means for creating performance information; and assigning means for, when the performance information creating means creates the performance information, selecting one of a plurality of string sound generating means on the basis of their preceding tone-generation assignment state, thereby assigning tone-generation corresponding to the created performance information to the selected string sound generating means.

In a second aspect of the present invention, there is provided an electronic musical instrument comprising:

a plurality of string sound generating means each forming a musical tone waveform signal having a different tone color;

performance information creating means for creating performance information including pitch information; and assigning means for, when the performance information creating means creates the performance information, determining and then assigning tone-generation to one of the string sound generating means and its fingering position with respect to the created performance information on the basis of the string sound generating means and its fingering position corresponding to the musical tone waveform signal which is precedingly generated.

In a third aspect of the present invention, there is provided an electronic musical instrument comprising:

a plurality of tone-generation means each forming one musical tone independently;

tone-generation designating means for designating the tone-generation means to form the musical tone having a designated pitch; and judging means for, when the tone-generation designating means designates to form a new musical tone while at least one tone-generation means is now operating to form certain musical tone, judging whether or not it is possible to simultaneously generate both of certain musical tone and the new musical tone on the basis of their pitch difference, so that when it is judged that simultaneous tone-generation is impossible, the judging means designate the tone-generation means to suspend generation of certain musical tone.

In a fourth aspect of the present invention, there is provided an electronic musical instrument comprising:

a plurality of string sound generating means each of which is designated by a string number wherein a pitch is designated by a fingering position;

tone-generation designating means for designating the string sound generating means to form a musical tone having a designated pitch;

determining means for determining the string number and the fingering position on the basis of the pitch which is designated by the tone-generation designating means; and judging means for judging whether or not the string number determined by the determining means is a continuous number of a string number corresponding to a musical tone which is presently generating, the judging means judging that simultaneous tone-generation is impossible when the determined string number does not continue to the string number, thereby designating the string sound generating means to suspend generation of the presently generating musical tone.

In a fifth aspect of the present invention, there is provided an electronic musical instrument comprising:

a plurality of string sound generating means each of which is designated by a string number wherein a pitch is designated by a fingering position;

tone-generation designating means for designating the string sound generating means to form a musical tone having a designated pitch;

determining means for determining the string number and the fingering position on the basis of the pitch which is designated by the tone-generation designating means; and judging means for, on the basis of a first string number and a first fingering position determined by the determining means and a second string number and a second fingering position corresponding to the musical tone which is presently generating, judging whether or not there is established a condition where the first and second string numbers are different from each other and a difference beteen the first and second fingering positions is within a predermined range, the judging means judging that simultaneous tone-generation is impossible when the condition is not established, thereby designating the string sound generating means to suspend generation of the presently generating musical tone.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIGS. 9 to 21 are flowcharts showing operations of the present embodiment; and

DESCRIPTION OF THE PREFERRED EMBODIMENT

[A] Configuration

Figure 1:
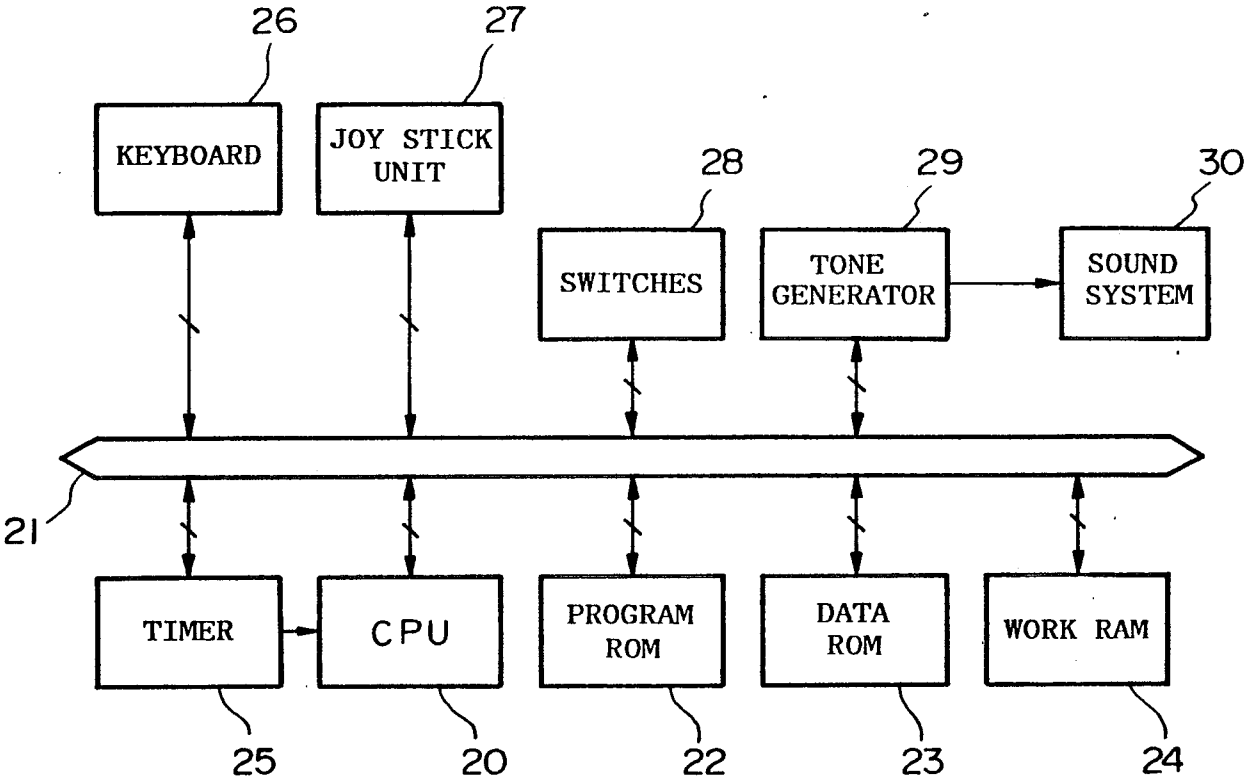
FIG. 1 is a block diagram showing an electric configuration of an electronic musical instrument according to an embodiment of the present invention.

FIG. 1 is a block diagram showing an electric configuration of an electronic musical instrument according to an embodiment of the present invention. This electronic musical instrument can simulate the performance of the string-bowing instrument such as the cello and violin. As the foregoing performance unit, it provides a keyboard 26 and a joy stick unit 27. The keyboard 26 is designed to control the pitch of the musical tone to be generated and also perform the tone-generation/suspension control. The joy stick unit 27 is designed to simulate the bowing operation of the string-bowing instrument. Therefore, by being operated as similar to the bow, the joy stick unit 27 controls the tone color. Meanwhile, a tone generator 29 has a configuration simulating a sounding system of the string-bowing instrument having four strings. When the performer designates certain pitch, a central processing unit (CPU) 20 selects one of the strings (or one of the tone colors of the strings) by which the musical tone having the designated pitch is to be generated. Herein, the tone generator 29 forms the musical tone in form of the musical tone waveform signal having the quantized digital value. Such digital signal is converted into the analog signal, which is used as the musical tone signal.

The above-mentioned CPU 20, keyboard 26, joy stick unit 27 and tone generator 29 are connected together via a bus 21. In addition, the bus 21 is also connected with a program read-only memory (ROM) 22, a data ROM 23, a work random-access memory (RAM) 24, a timer 25 and switches 28. The program ROM memorizes programs corresponding to the contents of flow charts as shown in FIGS. 9 to 21, while the data ROM 23 memorizes the contents of the tables of tone color data and fingering data (see FIGS. 7A, 7B). In addition, several kinds of registers (see FIG. 8) are set in the work RAM. The timer 25 is used to perform an interruption process for the CPU 20 by every predetermined period of time (i.e., approximately 10 ms). Upon receipt of such interruption clock, the CPU 20 executes the timer interruption process. Further, the switches 28 includes tone color control switches. The tone generator 29 is designed as the sound source unit simulating the sounding system of the string-bowing instrument, which will be described in conjunction with FIGS. 2 to 4. Upon receipt of the parameters representative of the bowing velocity, bowing pressure, length of bow, filter coefficients etc., the tone generator 29 forms the predetermined musical tone waveform signal. This rone generator 29 is coupled with a sound system 30, which amplifies the musical tone signal from the tone generator 29 to thereby generate the corresponding musical tone from its speaker.

Figure 2:
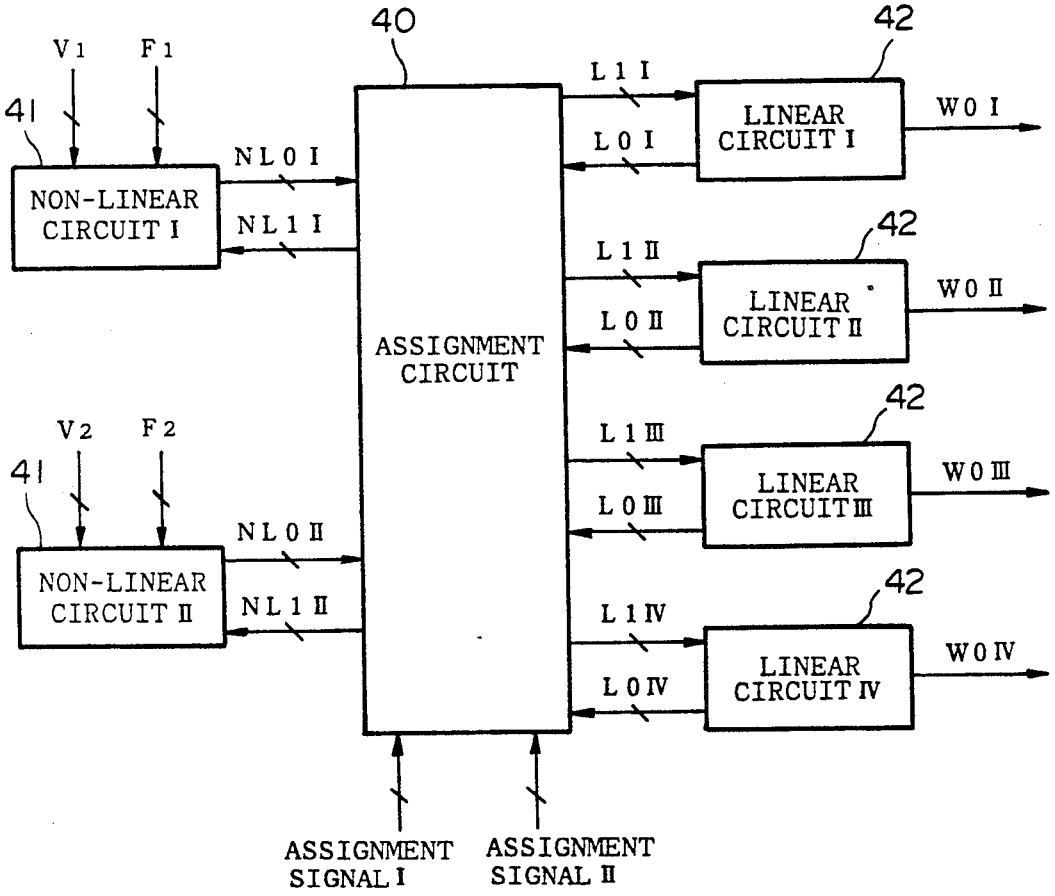
FIG. 2 is a block diagram showing a detailed configuration of a tone generator of the electronic musical instrument shown in FIG. 1.
Figure 3A:
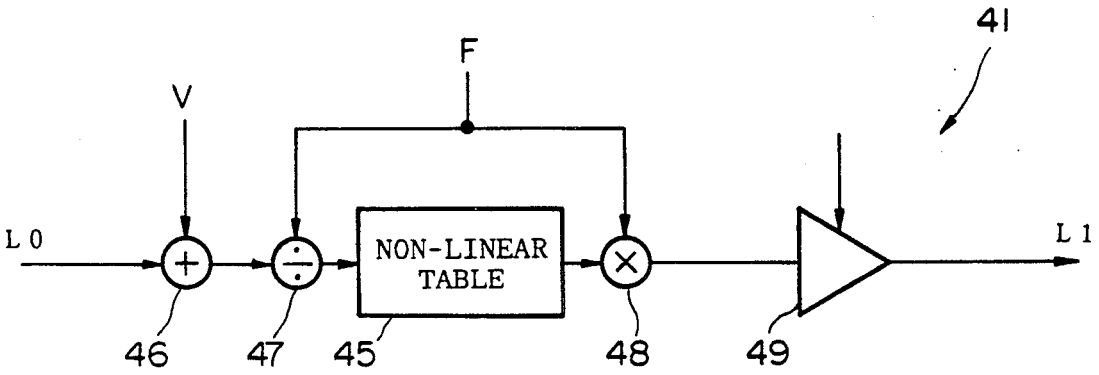
FIG. 3A is a flock diagram showning a non-linear circuit provided in the tone generator.
Figure 3B:
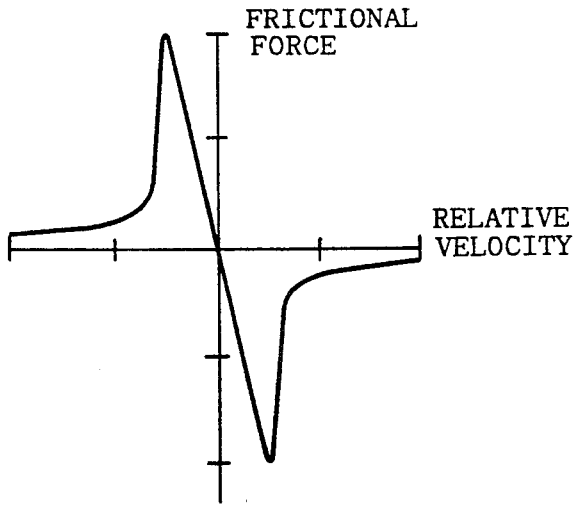
FIG. 3B is a graph showing a non-linear characteristic employed in the non-linear circuit.
Figure 4:
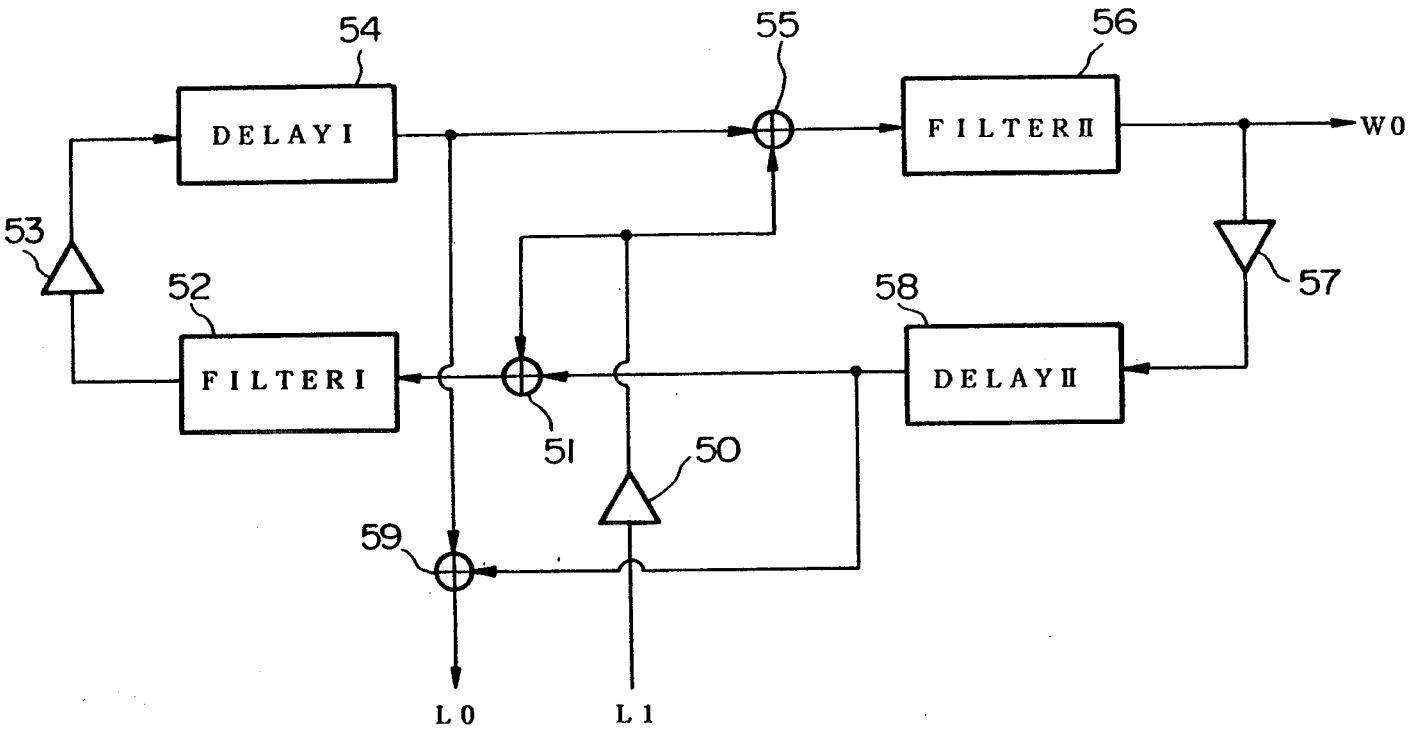
FIG. 4 is a block diagram showing a linear circuit provided in the tone generator.

FIGS. 2 to 4 illustrates detailed configuration of the tone generator 29. Herein, FIG. 2 illustrates the whole configuration of the tone generator 29; FIGS. 3A, 3B illustrate the detailed configuration of non-linear circuit and non-linear table characteristic respectively; and FIG. 4 illustrates the detailed configuration of linear circuit.

This tone generator 29 is configured to well simulate the physical structure of the actual string-bowing instrument. In the string-bowing instrument such as the violin, the string is vibrated by bowing the string, and such vibration is transmitted to the body wherein it is resonated so that the musical tone is produced. Herein, the string vibration which is made by bowing the string does not have the linear characteristic. In order to obtain an exact simulation, there is provided a table memorizing data representing the force to be applied to the string from the bow, and such data is read from the table based on relative velocity between the bow and string. In order to achieve such simulation, a non-linear circuit 41 is provided as shown in FIG. 2. Meanwhile, the string vibration can be simulated by use of the linear transmission function. In order to achieve such simulation, a linear circuit 42 is provided. In general, it is possible to execute the simultaneous performance using two strings (i.e., "double stop" technique) in the string-bowing instrument such as the violin. For this reason, there is provided two non-linear circuits 41. Since each string has a different vibration characteristic, there is provided four linear circuits 42 each corresponding to each of four strings. These circuits 41, 42 are connected to an assignment circuit 40. The CPU outputs parameters and assignment signals to the assignment circuit 40. Based on the assignment signal, the inputted parameters are supplied to any one of the non-linear circuits 41 or linear circuits 42. Based on the parameters representing the bowing velocity and bowing pressure etc., the non-linear circuit 41 computes vibration energy. On the other hand, the linear circuit 42 inputs the parameter representing the finger position etc. and the above-mentioned vibration energy from the non-linear circuit 41. Based on such data, the linear circuit forms the musical tone waveform signal.

As shown in FIG. 3A, the non-linear circuit 41 provides a non-linear table 45. Based on the relative velocity between the bow and string, data representing the frictional force (i.e., vibration energy) is read from this table 45. In the present embodiment, relationship between the relative velocity and frictional force is set corresponding to the simulation characteristic as expressed by the curve shown in FIG. 3B.

In FIG. 3B, horizontal axis represents the relative velocity between the bowing velocity and string-vibration velocity, while vertical axis represents the frictional force. According to the characteristic of this curve, the frictional force is increased in proportional manner while the relative velocity is in the range of small values; but, when the relative velocity exceeds over the certain value (at which the maximum frictional force is obtained), the frictional force is rapidly decreased (in other words, a grip is lost on the frictional force); and then, when the relative velocity becomes further larger, the frictional force is gradually decreased as the relative velocity becomes larger. This characteristic simulates the actual performance technique of the bow. The relative velocity in the range of small values wherein the frictional force is increased in proportional manner is used for the normal performance technique. In this case, when the bowing velocity is raised so that the grip ratio becomes lower, the falsetto sound is to be generated as similar to the actual string-bowing instrument. Such characteristic is effective when intentionally embodying the falsetto performance. By generating the falsetto sound which is not preferable essentially, it is possible to obtain the reality in the performance made by the electronic musical instrument. Due to the symmetry of this curve with respect to the zero point, it is possible to creates approximately the same sound in both of the down-bow and up-bow. In addition, this curve represents the relationship between the relative velocity and frictional force under the condition where the bowing pressure is constant. In case of the variable bowing pressure, this curve is expanded or contracted in direction of the vertical axis (or horizontal axis). In this case, the expanded or contracted curve may have a shape which is similar or not similar to the curve shown in FIG. 3B.

In FIG. 3A, an adder 46 and a divider 47 are connected to input side of the non-linear table 45, while a multiplier 48 and an amplifier 49 are connected to output side of the non-linear table 45.

The adder 46 inputs a velocity signal V which is outputted from the CPU 20 and vibration data LO which is fed back from the linear circuit 42. The addition result of the adder 46 is supplied to the divider 47 wherein it is divided by bowing pressure data F which is outputted from the CPU 20. Then, the division result is inputted into the non-linear table 45. The frictional force data outputted from the non-linear table 45 is multiplied by the bowing pressure data F in the multiplier 48, and the multiplication result is outputted to the assignment circuit 40 (or linear circuit 42) via the amplifier 49. Incidentally, a frictional characteristic control signal is applied to the amplifier 49. This frictional characteristic control signal is used to control the frictional coefficients, i.e., friction between the bow and string. Under control of this signal, it is possible to control the tension or sharpness of the sound. The above-mentioned circuit configuration can offer the good simulation of the vibration energy which is increased or decreased in response to the bowing velocity or bowing pressure.

In FIG. 4, the frictional force data LI outputted from the non-linear circuit 41 is applied to an amplifier, from which it is delivered to a first linear processing portion, consisting of a filter 52, an amplifier 53 and a delay circuit 54, via an adder 51, while it is also delivered to a second linear processing portion, consisting of a filter 56, an amplifier 57 and a delay circuit 58, via an adder 55. The first linear processing portion is a simulation model which simulates the transmission/resonance characteristic of the string vibration in direction of the nut side of string, while the second linear processing portion is a simulation model which simulates the transmission/resonance characteristic of the string vibration in direction of the bridge side of string. Herein, parameters representing the bowing position, fingering position and the like are inputted into the filters 52, 56, amplifiers 53, 57 and delay circuits 54, 58. Based on these parameters, the transmission characteristic, gain and delay time are adjusted. In addition, the string vibration to be transmitted or resonated at one side of the string (i.e., bridge side or nut side of the string) is transmitted toward another side of the string. For this reason, output of the first linear processing portion (see delay circuit 54) is supplied to the second linear processing portion via the adder 55. Similarly, output of the second linear processing portion (see delay circuit 58) is supplied to the first linear processing portion via the adder 51. Further, the string vibration affects the frictional characteristic between the string and bow (i.e., variation of the relative velocity). For this reason, both of the outputs of the first and second linear processing portions are added together in an adder 59, and then the addition result LO is fed back to the foregoing non-linear circuit 41. The signal passing through the filter 56 is picked up as the musical tone which is resonated in the body of the instrument.

Incidentally, two non-linear circuits 41 is identified by channel number i=0/1, while four linear circuits 42 is identified by string number S=1–4.

Figure 5A:
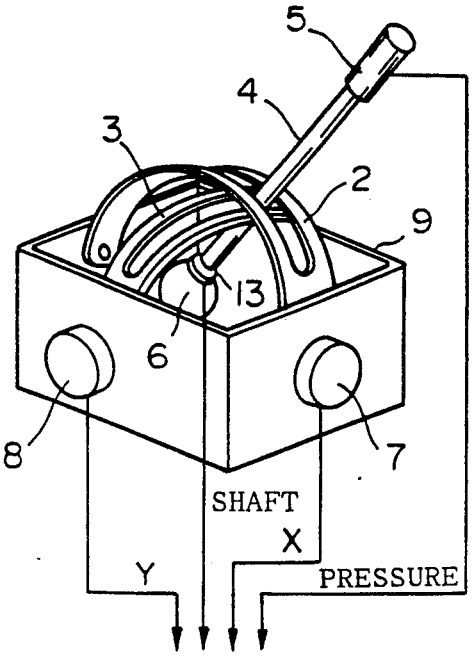
FIGS. 5A, 5B, 6A, 6B are perspective side views illustrating a construction of a joy stick unit.
Figure 5B:
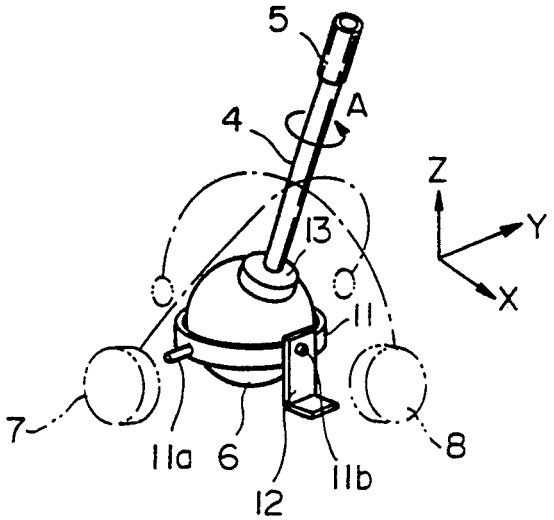
Figure 6A:
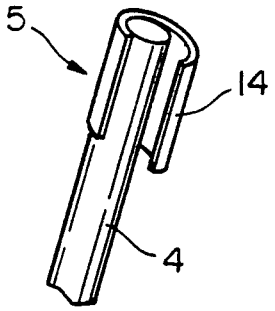
Figure 6B:
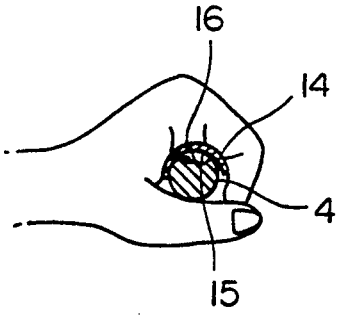

FIGS. 5, 6 illustrate the joy stick unit 27. This joy stick unit 27 provided in the electronic musical instrument according an an embodiment of the present invention has a function similar to that of the bow of the string-bowing instrument. Herein, a stick 4 is projected from the body of the joy stick unit 27, while a grip 5 is formed at a tip edge portion of this stick 4. The performer holds this grip 5 (see FIG. 6B), so that he can move the stick 4 forward, backward and sideways, rotate it or vary the holding power of the grip 5. The movement of the stick 4 corresponds to the bowing operation; the holding power of the grip 5 corresponds to the bowing pressure; and rotating angle of the stick 4 corresponds to the ratio between the nut-side length and bridge-side length of the string with respect to the bow to be in contact with the string.

The stick 4 is formed to coincide with the rotary axis of a rotary sensor 13 fixed onto a support ball 6. The support ball 6 is supported by a frame 11 and a stand member 12 such that it can freely swing in arbitrary direction. More specifically, the support ball 6 is supported by a fulcrum **11*a* such that it can freely swing about Y axis with respect to the frame 11 (see FIG. 5B), while the frame 11 is supported by another fulcrum 11*b* such that it can freely swing about X axis with respect to the stand member 12**.

In addition, the stick 4 is positioned to be inserted in slit portions of guides 2, 3. The guides 2, 3 each having an oval slit are formed in an arched shape, wherein both edges thereof are supported by a box 9 such that they can freely rotate. Herein, an axis by which both edges of the guide 2 are supported coincides with X axis, so that the oval slit of the guide 2 is formed in direction of X axis. Thus, when the stick 4 is rotated about X axis, side portions of the slit come in contact with the stick 4 so that the guide 2 is moved to follow the movement of the stick 4. In contrast, when the stick 4 is rotated about Y axis, it moves along with the slit of the guide 2 so that the guide 2 is not moved to follow the movement of the stick 4. At one supporting point of the guide 2, a rotary sensor 7 is attached to sense the rotating angle of the stick 4 to be rotated about X axis. Similarly, an axis by which both edges of the guide 3 are supported coincides with Y axis, so that the slit of the guide 3 is formed in direction of Y axis. Thus, when the stick 4 is rotated about Y axis, the guide 3 is moved to follow the movement of the stick 4. However, when the stick 4 is rotated about X axis, it won't touch with the side portions of the slit so that the guide 3 is not moved to follow the movement of the stick 4. At one supporting point of the guide 3, a rotary sensor 8 is attached to sense the rotating angle of the stick 4 to be rotated about Y axis. By use of the rotary sensors 7, 8, 13, it is possible to detect the rotating angle of the stick to be rotated about X axis, Y axis and axis of the stick 4. The rotary sensor can be embodied by use of the rotary control, rotary encoder and the like.

As illustrated in FIGS. 6A, 6B, the grip 5 is configured such that a pressure sensor 15 and a spring 16 is contained within a cover 14. The spring 16 imparts the spring force and thereby form a gap between the stick 4 and cover 14. The pressure sensor 15 is positioned to be in contact with the inside of the cover 14. When the performer holds the cover 14 to press it against the spring force applied by the spring 16, the gap between the stick 4 and cover 14 is narrowed, which is detected by the pressure sensor 15. Herein, the pressure sensor 15 can be constructed by use of the distortion gage semiconductor, piezoelectric element and the like.

Figures 7A, 7B:
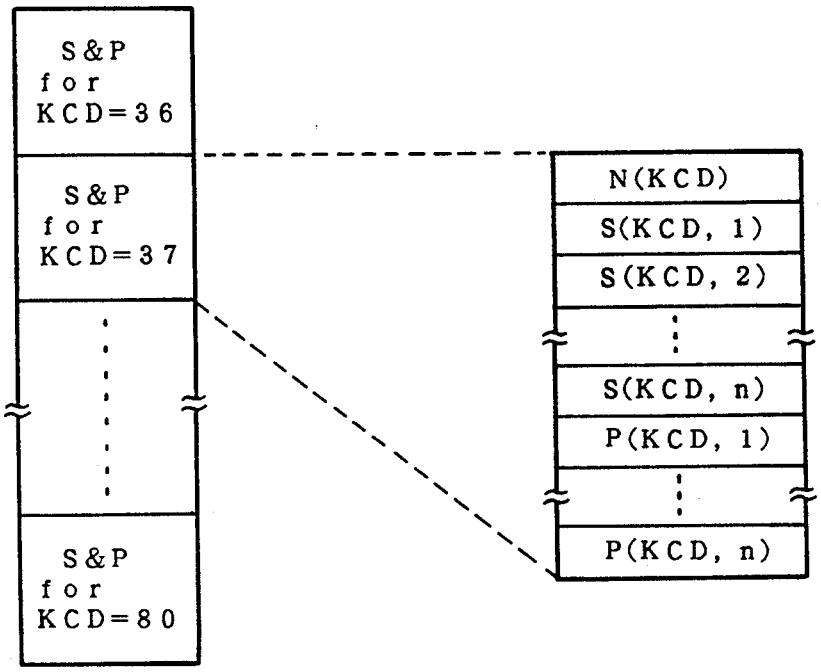
FIG. 7A shows the contents of fingering data table which is memorized in a data ROM provided in the present embodiment.
FIG. 7B shows relationship among strings, positions and keycodes in case of the cello.

FIG. 7A shows the contents of the fingering data table which is set in the foregoing data ROM 23. This table memorizes combination of string S and position P which can be designated by each keycode. More specifically, since the tone generator 29 simulates the four-string-type string-bowing instrument, the keycode is designated by the string S to be used and position P at which the finger depresses the string. Herein, each value of string data (i.e., S=1–4) corresponds to each of four linear circuits 42 provided within the tone generator 29. Meanwhile, each string has a different tone range within which the sound is generated. Therefore, plural kinds of the combinations of strings and positions can be existed with respect to the same keycode, all of which information is memorized in this table. The area of the table is divided by each keycode KCD, and each keycode area contains variation number of the keycode N(KCD), string data S(KCD, 1−N) and position data P(KCD, 1−N).

FIG. 7B shows the contents of table which memorizes the keycodes to be designated with respect to each string. This table corresponds to the keycodes of the cello. For example, in case of the open-fret position (i.e., P=0) of first string (i.e., S=1), pitch of keycode 57(A2) is designated. Accompanied with upward movement of the fingering position by which pitch becomes higher, pitch can be designated toward keycode 80(G#4). Herein, keycode 80(G#4) corresponds to the maximum pitch within the tone range which can be sounded without departing from the limit of the finger board of the cello. Such limit is different in each stringed instrument to be simulated in the present invention. In the present embodiment, tone G#4 is set as the upper limit with respect to the first string. Similarly, keycodes 50–73 are set for the pitches of second string (S=2); keycodes 43–66 are set for the pitches of third string (S=3); and keycodes 36–59 are set for the pitches of fourth string (S=4).

It is apparent from the contents of the above-mentioned table that the same keycode can be designated by plural strings. In this case, kind of the string to be actually used is determined under control of the CPU 20, which will be described later.

Figure 8:
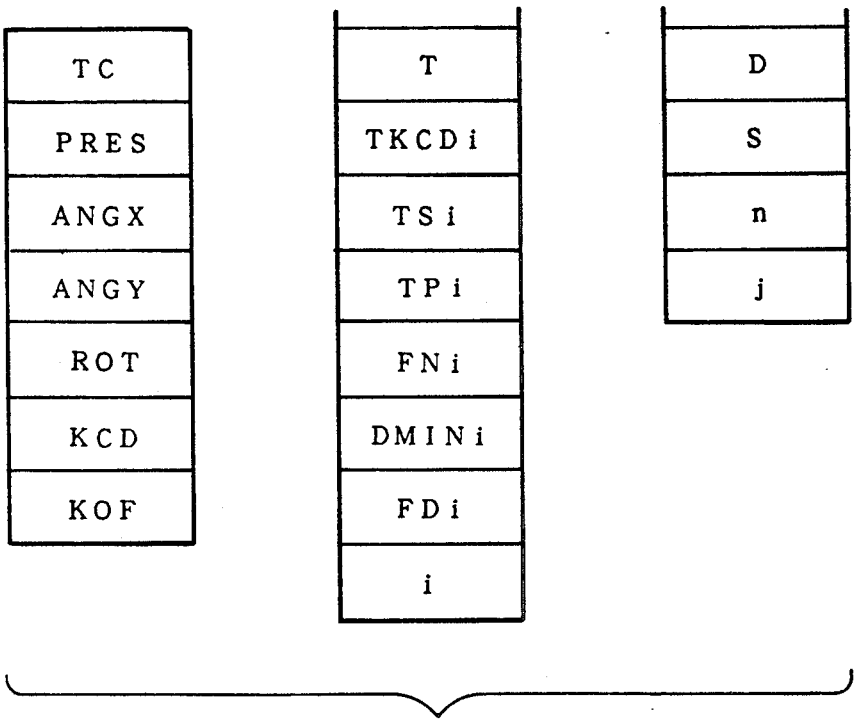
FIG. 8 shows registers which are set in a work RAM provided in the present embodiment.

FIG. 8 shows registers to be set in the foregoing work RAM. Herein, only the name of each register is described below, and its function will be described later by referring to the flowchart.

TC: tone color number register
PRES: pressure register
ANGX: X-angle register
ANGY: Y-angle register
ROT: rotating angle register
KCD: keycode register
KOF: key-off flag
T: timer register
TKCDi: tone-generation keycode register
TSi: tone-generation string register
TPi: tone-generation position register
FNi: fingering number register
DMINi: minimum difficulty register
D: difficulty register
i: channel pointer
n: variation number register
j: variation pointer
s: string register Other than the above-mentioned registers, the data ROM 23 memorizes the following data.

THRL: threshold value
k: string-change-difficulty coefficient
WT: wait time
MPD: maximum position difference

[B] Operation

FIGS. 9 to 21 show flowcharts representing the operations of the electronic musical instrument according to an embodiment of the present invention.

FIG. 9 shows a main routine. When the power is on, the CPU 20 executes an initializing operation (n1) wherein the registers are reset at first. Thereafter, it will repeatedly execute key process routine (n2), joy stick processing routine (n3) and routine of other processings (n4) wherein operations of the other switches and controls are to be performed. The key process routine corresponds to the tone-generation/suspension control which is made in response to the operation of the keyboard 26. In the joy stick processing routine, parameters to be supplied to the non-linear circuit 41 in the tone generator 29 are determined in response to the manipulation of the joy stick unit 27. The routine of other processings shosn in FIG. 9 contains tone color switch-on event routine as shown in FIG. 10. The above-mentioned processings are repeatedly executed until the power is off.

FIG. 10 shows the tone color switch-on event routine. When the tone color switch is on, the corresponding tone color number is set to the tone color number register TC in step (n6). Then, tone color data corresponding to such tone color number is read from the data ROM 23, and it is transferred to a tone color buffer in step (n7). This tone color data is set in the non-linear circuit 41 and linear circuit 42 within the tone generator 29 in step (n8).

FIG. 11 shows the joy stick processing routine. Accompanied with the manipulation of the joy stick, data representing the pressure, X-axis rotating angle, Y-axis rotating angle and rotating angle of the stick are read out, and they are respectively stored in the pressure register PRES, X-angle register ANGX, Y-angle register ANGY and rotating angle register ROT in step (n11). In next step (n12), it is judged whether or not the value of the pressure register PRES exceeds over the threshold value THRL. If value of the pressure register PRES exceeds over the threshold value THRL, processes of steps (n13) to (n15) are executed. If not, it is judged that the performer does not manipulates the joy stick actually, and then the processing is directly returned to its original process from step (n12). In step (n13), the CPU 20 detects the variation velocity of the rotating angles stored in the X-angle register ANGX and Y-angle register ANGY, and then detected velocity is sent to the non-linear circuit 41 in the tone generator 29 as the bowing velocity. In addition, value of the pressure register PRES is sent to the non-linear circuit 41 as the bowing pressure in step (n14). Further, bowing position data corresponding to value of the rotating angle register ROT is sent to the linear circuit 42 in step (n15). Lastly, the wait time WT is set in the timer register T in step (n16), and then processings of the joy stick processing routine are completed. Therefore, as long as the joy stick is manipulated, count value of the timer register T is not progressed.

Incidentally, in the performance, the joy stick unit 27 is always operated. Therefore, processings of the routine shown in FIG. 11 can be set as timer interrupt process which is executed by every constant time.

FIG. 12 shows key-on event routine. In the present electronic musical instrument, pitch is designated by depressing a key of the keyboard 26. When the pitch is designated, assignment is made with respect to the tone-generation channel and tone-generation string. In addition, it is judged whether or not plural tones are simultaneously generated. This judgement is made to simulate the performance state of the actual string-bowing instrument such as the cello.

First, keycode of the depressed key is set to the keycode register KCD in step (n20). In next step (n21), it is judged whether or not the key-off flag KOF is set. In the case where the key-off flag KOF is set, it can be read that there are no other keys to be depressed. In this case, the key-off flag KOF is reset in step (n22), and then it is judged whether or not the value of the timer register T is at zero in step (n23). If value of the timer register T is at zero, it can be judged that enough time has been passed after the preceding key-off event (i.e., tone-suspension event). Therefore, there is established a condition where the performer can freely move his fingers of left hand to any positions, and then the processing proceeds to a new tone-generation routine consisting of processes of steps (n24) to (n27). On the other hand, when value of the timer register T is not at zero (or it is equal to or larger than "1"), it is judged that enough time has not been passed after the preceding key-off event. Therefore, there is established a condition where the performer does not depart his fingers of left hand from the preceding positions, which indicates that newly designated positions must be affected by the preceding positions. Thus, the processing proceeds to a continuous tone-generation routine consisting of processes of steps (n28) to (n30).

In the new tone-generation routine, the CPU 20 executes processes of string assignment routine (n24), string-fingering assignment routine (n25) and channel assignment routine (n26), and then the keycode KCD is set to the tone-generation keycode register TKCDi. Thereafter, the processing is returned. In the above-mentioned string assignment routine (n24), as shown in FIG. 13, the CPU 20 determines the string (i.e., linear circuit 42) from which the musical tone is to be generated. In the string-fingering assignment routine (n25), as shown in FIG. 14, the CPU 20 searches the position of the assigned string at which the musical tone having the designated keycode is to be generated. In the channel assignment routine, as shown in FIG. 15, the CPU 20 selects one of two non-linear circuits 41 (i.e., channel 0/1) of the toner generator 29 as the circuit to which tone-generation of the above-mentioned musical tone is assigned.

Meanwhile, in the continuous tone-generation routine, optimum fingering assignment routine (n28) is executed at first, and then channel assignment routine (n29) is executed. Thereafter, the keycode KCD is set to the tone-generation keycode register TKCDi in step (n30), and then the processing is returned. In the optimum fingering assignment routine, as shown in FIG. 16, the CPU 20 determines the contents of the fingering operation (i.e., string S and position P) by which the fingering state is varied from the preceding fingering state so that the designated pitch can be obtained with great ease.

In step (n21), if the key-off flag KOF is reset, the CPU 20 counts number of the activated non-linear circuits 41, i.e., number of on-channels to which the tone-generation is assigned in step (n31). Normally, such number is one or two. In the case where there exist only one on-channel, the processing proceeds to step (n32). If there are two on-channels, the processing proceeds to steps (n38) to (n43).

When the processing proceeds to step (n32) because there is only one on-channel, the CPU 20 will executes processes of judgement routine for simultaneous tone-generation in step (n39). In this routine, as shown in FIG. 17, it is judged whether or not the performer put his finger on new position without moving fingers of his left hand on the positions at which the musical tones are now generated. In other words, it is judged whether or not the newly designated musical tone can be generated without suspending generation of the musical tones which are presently generated. If the present system enables the simultaneous tone-generation, the CPU 20 computes the string number S and position number P with respect to the newly designated musical tone. In this case, judgement result of step (n33) is "YES", so that the processing proceeds to steps (n34) and (n37). In step (n34), the channel pointer i (which is at "0"/"1") is inverted. Then, from the fingering data table, the CPU 20 computes the string number S(KCD, FNi) and position P(KCD, FNi), which are respectively stored in the tone-generation string register TSi and tone-generation position register TPi. Thereafter, the above-mentioned data are sent to the non-linear circuit 41 corresponding to channel i to thereby start generation of the designated musical tone. Lastly, this keycode KCD is stored in the tone-generation keycode register TKCDi, thus, completing the above-mentioned processes. On the other hand, if the foregoing judgement routine (n32) judges that the present system is not afford to enable the simultaneous tone-generation, the judgement result of step (n33) turns to "NO" so that the processing proceeds to the foregoing continuous tone-generation routine (n28–n30). In this case, the CPU 20 suspend generation of the musical tone which is continuously generated until now, and then it operates to perform generation of the newly designated musical tone.

Meanwhile, if step (n31) judges that there are two on-channels, the CPU 20 performs the foregoing judgement routine for simultaneous tone-generation with respect to each of channels 0, 1 is steps (n38)–(n41). By referring to the result of the above-mentioned process, the CPU 20 performs selection execution routine (see FIG. 18, (n42)). Therefore, the keycode KCD is stored in the tone-generation keycode register TKCDi in step (n43), and then the processing is returned. In the selection execution routine, when generating the new musical tone, the CPU 20 determines to suspend generation of one or two of two musical tones which have been already generated.

FIG. 13 shows the string assignment routine. This routine is activated when newly generating the musical tone under the state where no musical tone has been generated until now. In short, tone-generation assignment is made to one of the strings (i.e., one of the linear circuits 42) with respect to the newly designated musical tone. Herein, standard tone range of the string to be used is assigned to the linear circuit 42. At first, the CPU 20 evaluates the designated keycode KCD in step (n46). Responsive to the value range of the designated keycode, the string number is adequately selected and it is set to the string number register S is step (n47). More specifically, "4" is set to the string number register S in case of KCD=36-43 (i.e., C1-G1); "3" is set to S in case of KCD=44-50 i.e., G#1-D2); and "2" is set to S in case of KCD=51-57 (i.e., D#2-A2). If value of the keycode KCD exceeds over "57", as long as it is within the limit of the tone-generation range of the string, "1" is set to the string number register S in case of KCD=58-80 (i.e., A#2-G#4). According to the algorithm of the flowchart shown in FIG. 13, the open-fret position other than "C" is not welcomed, therefore, other lower positions are adopted. However, the present invention is not limited to such algorithm. Of course, it is possible to employ other algorithms in which the open-fret position or other higher positions are used. If the present system provides a selection switch for selecting one of the algorithms, all of the possible algorithms can be executed.

FIG. 14 shows the string-fingering assignment routine. In this routine, the position P corresponding to the keycode KCD is computed with respect to the assigned string S. This process is executed by carrying out a searching operation on the fingering data table. In the fingering data table, at first, variation number N(KCD) corresponding to the keycode KCD is set to the variation number register n in step (n50). In addition, "1" is set to the varitation pointer j, and then it is judged whether or not the contents of S(KCD, j) coincide with the string number S which is assigned by the foregoing string assignment routine in step (n52). If coincidence is detected, value of the variation pointer j is held, and then the processing is returned. If not, until value of the variation pointer j becomes equal to or exceeds over value of the variation number register n, the above-mentioned process is repeatedly performed with respect to the incremented value of the variation pointer j (see (n53), (n54)). Even if "j≧n" is established, when S(KCD, j) does not coincide with the assigned string number S, the processing proceeds to step (n55) wherein an error processing is carried out, and then the processing is returned.

FIG. 15 shows the channel assignment routine. In order to transmit new data to the channel which is now operation to perform the tone-generation, this routine is provided. In step (n60), it is judged whether or not the contents of the tone-generation string register TSi corresponding to the tone-generation channel coincides with the string S(KCD, j) corresponding to the musical tone which is requested to be newly generated. If coincidence is detected, new position P(KCD, j) is set to the tone-generation position register TPi in step (n61). Then, the contents of this tone-generation position register TPi is sent to the tone-generation channel i, by which while continuing generation of the musical tone, the position is changed in step (n62). In this case, by providing a time delay when moving the fingering position, it is possible to obtain a portamento-like-effect.

Figure 22A:
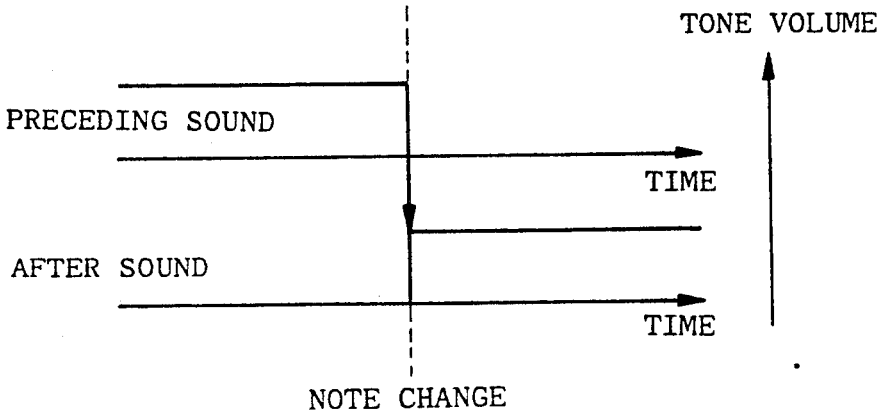
FIGS. 22A, 22B are drawings each showing a transit state of the musical tone to be generated from the present embodiment.
Figure 22B:
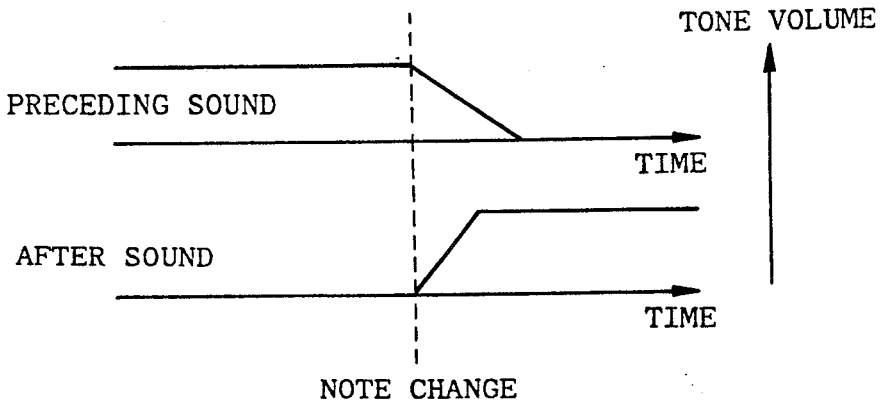

On the other hand, if the designated string S(KCD, j) does not coincide with the contents of the tone-generation string register TSi, this routine instructs the channel i to attenuate its output in step (n63). After inverting the channel pointer i in step (n64), the string number S(KCD, j) and position P(KCD, j) are determined with respect to the musical tone to be newly generated, and they are respectively set to the tone-generation string register TSi and tone-generation position register TPi. Then, these data are sent to the newly designated channel, thus starting to generate the new musical tone in step (n66). Thus, as illustrated in FIG. 22, "note change on same string", in which generating sound is changed on the same string, can be rapidly and smoothly carried out without remaining the precedingly generated sound (see FIG. 22A). On the other hand, "note change on different strings", in which the generating sound is changed by changing the using string, can be carried out such that the precedingly generated sound to be muted is overlapped with the newly generating sound.

FIG. 16 is a flowchart showing the optimum fingering assignment routine. In this routine, the most-natural combination of the string and position is computed with respect to the musical tone to be newly generated at a time when changing over the musical tone in the continuous tone-generation operation.

First, the fingering variation number N(KCD) corresponding to the new keycode is read from the fingering data table, and then it is set to the variation number register n in step (n70). In addition, "0" is set to the fingering number register FNi, and its maximum value ($FF_H$) is set to the minimum difficulty register DMINi in step (n71); and then "1" is set to the variation pointer j in step (n72). When shifting the string and position from those corresponding to the presently generating or precedingly generated musical tone to those corresponding to the musical tone to be newly generated, there is occurred a difficulty of the performing technique with respect to the change of the string and position in the stringed instrument. Thus, the present embodiment is designed to compute such difficulty in step (n73). Herein, the string and position of the new musical tone are designated by the variation pointer j. In short, the above-mentioned "difficulty" is calculated by the following formula.

$$D=[P(KCD, j)-TPi]^2+k*[S(KCD, j)-TSi]^2$$

Herein, "D" corresponds to a difficulty buffer; and "k" is a constant, i.e., $k>1$, corresponds to a difficulty degree representing a difficulty of one-string-change operation as comparing to one-position-change operation. After performing the above-mentioned calculation, the contents of the difficulty buffer D is compared to that of the minimum difficulty register DMINi in step (n74). In case of D<DMINi, the contents of D is set to DMINi. At this time, value of variation pointer j is set to the fingering number register FNi in step (n75). Then, the variation pointer j is incremented by "1" in step (n77), and until value of j becomes equal to or larger than value of the variation number register n in step (n76), processes of steps (n73)−(n77) are repeatedly performed. When "k≧n" is detected, the contents of the fingering number register FNi is set to the variation pointer j again in step (n78), and then the processing is returned. Due to this process, the variation number corresponding to the minimum difficulty (i.e., DMINi) is set to the variation pointer j.

FIG. 17 shows the judgement routine for simultaneous tone-generation. In this routine, it is judged whether or nor a new musical tone can be simultaneously generated in addition to the presently generating musical tone by simultaneously fingering on their positions with two fingers of the performer's left hand. In other words, it is judged whether or not two musical tones can be respectively sounded by two adjacent strings and difference of their positions is relatively small (i.e., it is less than the maximum position difference MPD).

First, the variation number N(KCD) corresponding to the newly designated musical tone is set to the variation number register n in step (n80), and "1" is set to the variation pointer j in step (n81). In step (n82), it is judged whether or not the string S(KCD,j) designated by the variation pointer j represents a string which is provided adjacent to the string of TSi corresponding to the precedingly designated musical tone to be presently generating. In short, it is judged whether or not a formula of "S(KCD,j)=TSi±1" is established.

In step (n83), it is judged whether or not a difference between the position P(KCD,j) designated by the variation pointer j and position TPi corresponding to the presently generating musical tone is within a range of the maximum position difference MPD. In short, it is judged whether or not a formula of "P(KCD,j)−TPi<MPD" is established.

If the above-mentioned two conditions are satisfied, the contents of this variation pointer j is set to the fingering number register FNi corresponding to channel i in step (n84). Thereafter, simultaneous tone-generation difficulty FDi is computed in step (n85), and then the processing is returned.

As similar the position change difficulty D corresponding to the string in the continuous tone-generation, the above-mentioned simultaneous tone-generation difficulty FDi can be computed by the following formula.

$$FDi=[P(KCD,j)-TPi]^2+k*[S(KCD,j)-TSi]^2$$

On the other hand, if either of two conditions (n82), (n83) is not satisfied, the variation pointer j is incremented by "1" in step (n87), and then the above-mentioned judgement processes are repeatedly executed. Even if these judgement processes are performed with respect to all variations but it is still impossible to find the variation in which the simultaneous tone-generation can be made (i.e., two conditions (n82), (n83) are satisfied), "0" is set to the fingering number register FNi in step (n88), and then the processing is returned.

FIG. 18 shows the selection execution routine. In this routine which is activated under the condition where two musical tones have been already generated and generation of the new musical tone is instructed, it is determined whether or not generation of one of two musical tones or both of them is suspended. This routine is performed in step (n42) of the key-on event routine (see FIG. 12). Therefore, before performing this routine, the foregoing judgement routine for simultaneous tone-generation (see FIG. 17) is performed with respect to each of the tone-generation channels 0, 1. In first step (n90), this selection execution routine evaluates the contents of the fingering number register FNi with respect to each channel (0,1). If both of FN0, FN1, are at zero, simultaneous tone-generation cannot be made for both of the generating musical tones, so that the processing proceeds to step (n91) wherein routine for varying number of generating tones is carried out. On the other hand, if one of FN0, FN1 is not at zero but the other of them is at zero, the channel of which FN is not at zero is set to the channel pointer i in step (n92), (n93), and then the processing proceeds to step (n97). Further, if both of FN0, FN1 are not at zero, this routine compares the contents of the simultaneous tone-generation difficulties FD0, FD1 in step (n94), and one of them of which difficulty level is smaller is set to the channel pointer i in step (n95), (n96), and then the processing proceeds to step (n97). In step (n97), the string S(KCD,FNi) and position P(KCD,FNi) designated by the fingering number register FNi are respectively set to the tone-generation string register TSi and tone-generation position register TPi. These data are sent to the non-linear circuit 41 corresponding to channel i and linear circuit 42 corresponding to the string S respectively, thereby changing the contents of tone-generation in channel i in step (n98).

FIG. 19 shows the routine for varying number of generating tones. This routine is activated when changing the tone-generation state from two-sound-simultaneous-generation to single-sound-generation.

In first step (n100), it is judged whether or not the string (KCD,j) corresponding to the musical tone to be newly generated coincides with either of two strings TS0, TS1 corresponding to two musical tones which are presently generating. In other words, this process judges whether or not it coincides with the strings (i.e., linear circuits) assigned to 2-channel non-linear circuit. When there is found a channel coinciding with the string of new musical tone, generation of the musical tone of such channel is continued. More specifically, the channel number 0/1 is set to the channel pointer i in step (n101), (n102), and the output attenuation instruction is sent to the other channel (of which string number does not coincide with that of the new musical tone) in step (n103). In step (n104), the position P(KCD,j) is set to the tone-generation position register TPi of which tone-generation is continued. In step (n105), this data is sent to channel i of the tone generator 29, thereby changing the pitch of the musical tone in channel i.

On the other hand, if the process of step (n100) judges that the string for the new musical tone is different from both of the strings corresponding to channels 0, 1, the foregoing optimum fingering assignment routine is carried out with respect to channels 0, 1 respectively in steps (n106)-(n109). Thus, minimum difficulties DMIN0, DMIN1 respectively corresponding to channels 0, 1 are compared to each other in step (n110). Under consideration of these difficulties, the present embodiment is designed to set the channel of which difficulty is smaller as the channel for generating the new musical tone. Therefore, such channel number is set to the channel pointer i in step (n111), (n113). At this channel, value of the fingering number register FNi, i.e., the fingering variation corresponding to the minimum difficulty, is set to the variation pointer j in step (n112), (n114). Thereafter, the output attenuation instruction is sent to both channels in step (n115). In next step (n116), the string S(KCD,j) and position P(KCD,j) corresponding to the new musical tone are respectively set to the tone-generation string register TSi and tone-generation position register TPi corresponding to the designated channel i. In last step (n117), these data are sent to channel i of the tone generator 29, thereby starting to generate the new musical tone.

The processes described heretofore correspond to the tone-generation start operation to be activated accompanied with the key-on event. FIG. 20 shows the key-off event routine. When the key-off event is occurred, keycode of the corresponding key is inputted into the keycode register KCD in step (n121). If the key-off event relates to all keys of the keyboard 26, the key-off flag KOF is set in step (n123), and the wait time WT is set to the timer register T in step (n124), thus terminating the key-off event routine. On the other hand, if the present key-off event does not relate to all keys, the processing directly proceeds to step (n125) wherein the CPU 20 searches the keycode identical to KCD in the tone-generation keycode register TKCDi. If such keycode is found, the output attenuation instruction is sent to the corresponding channel in step (n127), and then the processing is returned. If not found, the processing is directly returned because generation of the musical tone is suspended before the key-off event.

FIG. 21 shows the timer interrupt routine. This is the interrupt process which is repeatedly carried out by every 10 ms, approximately. In first step (n130), it is judged whether or not the key-off flag KOF is set. If not set, the processing is directly returned. If set, the processing proceeds to step (n131) wherein it is judged whether or not value of the timer register T is equal to or larger than "0". If so, value of the timer register T is decremented by "1" in step (n132), and then the processing is returned. On the other hand, if value of the timer register T is smaller than "0", the processing is directly returned. Due to the processes of this routine, time to be passed after the all-key-off event is measured. On the basis of this time, it is determined whether or not to generate the new musical tone or continue generation of the present musical tone at the next tone-generation timing.

As described heretofore, the present electronic musical instrument is designed similar to the string-bowing instrument in the performance method because it provides the joy stick unit 27. In addition, the non-linear circuit 41 and linear circuit 42 of the tone generator 29 are designed under consideration of the simulation model of the movement of bow and vibration of string in the string-bowing instrument. Therefore, it is possible to well reproduce the delicate performance expression of the string-bowing instrument such as the cello and violin. Incidentally, it is possible to omit the joy stick unit 27 and use the keyboard 26 only as the performance unit. In this case, it is necessary to form the parameters representing the bowing velocity, bowing pressure, bowing position and the like by processing the data representing the key-on intensity (i.e., key-on velocity), after-touch and the like.

Further, it is possible to additionally provide a display unit which displays the string and position assigned to each tone-generation channel.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument which simulates a sounding system of a stringed-instrument, comprising:

a plurality of string sound generating means each for forming a musical tone waveform signal having a different tone color;

performance information creating means for creating performance information including pitch information for each tone waveform signal to be formed; and assigning means for, when said performance information creating means creates said performance information for a new tone, selecting one of said plurality of string sound generating means on the basis of pitch information corresponding to a tone waveform signal currently being formed by one of the string sound generating means, thereby assigning tone-generation corresponding to the created performance information to the selected string sound generating means.

2. An electronic musical instrument as defined in claim 1 wherein said plurality of string sound generating means further comprises:

a plurality of non-linear circuits each of which has a non-linear characteristic and converts an input signal corresponding to the performance information into an output signal according to the non-linear characteristic;

a plurality of linear circuits each of which has a delay means for delaying a signal inputted thereto and a filter for filtering a signal inputted thereto; and an assignment circuit which receives an assignment signal so as to assign a non-linear circuit to a particular linear circuit in accordance with the received assignment signal.

3. An electronic musical instrument which simulates a sounding system of a stringed instrument, comprising:

a plurality of string sound generating means each for forming a musical tone waveform signal having a different tone color and a tone pitch within a predetermined pitch range which is different for each sound generating means, wherein said tone pitch is determined by fingering position information;

performance information creating means for creating performance information including pitch information for each tone signal to be formed; and assigning means for, when said performance information creating means creates said performance information for a new tone signal to be formed, determining which one of said string sound generating means to assign for tone signal formation and a fingering position for the created performance information, wherein said determination is made on the basis of both the string sound generating means and fingering position corresponding to a musical tone waveform signal which is currently being generated.

4. An electronic musical instrument as defined in claim 3 wherein, when the string sound generating means assigned to form the new tone signal is operating to form the tone signal which is currently being generated, pitch is varied in portamento manner from a fingering position at which the musical tone waveform signal is formed to another fingering position at which a new musical tone waveform signal is to be formed.

5. An electronic musical instrument as defined in claim 3 further including attenuation means for, when the string sound generating means assigned to form the new tone signal is different from the string sound generating means which is currently forming a musical tone waveform signal, gradually attenuating the current musical tone waveform signal.

6. An electronic musical instrument as defined in claim 3 further including a display means for displaying the assigned string sound generating means and its fingering position.

7. An electronic musical instrument which simulates a sounding system of a stringed instrument, comprising:

a plurality of tone-generation means each forming one musical tone independently;

tone-generation designating means for designating said tone-generation means to form the musical tone having a designated pitch; and judging means for, when said tone-generation designating means designates to form a new musical tone while at least one tone-generation means is currently operating to form a particular musical tone, judging whether or not it is possible to simultaneously generate both of said particular current musical tone and said new musical tone on the basis of their pitch difference, wherein when it is judged that simultaneous tone-generation is impossible, said judging means controls said tone-generation means to suspend generation of said particular current musical tone.

8. An electronic musical instrument which simulates a sounding system of a stringed instrument, comprising:

a plurality of string sound generating means each of which corresponds to a string number, wherein a pitch for a given string number is designated by a fingering position;

tone-generation designating means for designating said string sound generating means to form a new musical tone having a designated pitch;

determining means for determining said string number and said fingering position on the basis of the pitch which is designated by said tone-generation designating means; and judging means for judging whether or not said string number determined by said determining means is continuous in number progression with a string number corresponding to a musical tone which is currently being generated, said judging means judging that simultaneous tone-generation is impossible when the determined string number for the new tone is not continuous with said string number for the current tone, and designating said string sound generating means to suspend generation of the current tone.

9. An electronic musical instrument which simulates a sounding system of a stringed instrument, comprising:

a plurality of string sound generating means each of which is designated by a string number wherein a pitch is designated by a fingering position;

tone-generation designating means for designating said string sound generating means to form a musical tone having a designated pitch;

determining means for determining said string number and said fingering position on the basis of the pitch which is designated by said tone-generation designating means; and judging means for, on the basis of a first string number and a first fingering position determined by said determining means and a second string number and a second fingering position corresponding to the musical tone which is presently generating, judging whether or not there is established a condition where said first and second string numbers are different from each other and a difference between said first and second fingering positions is within a predetermined range, said judging means judging that simultaneous tone-generation is impossible when said condition is not established, thereby designating said string sound generating means to suspend generation of the presently generating musical tone.

10. An electronic musical instrument as defined in any one of claims 1, 3, 7, 8, 9 further comprising a bowing operation means which imparts a bowing effect to the musical tone in response to an operation made by a performer.

11. An electronic musical instrument as defined in claim 10 wherein said bowing operation means is configured as a joy stick unit so that the bowing effect is imparted to the musical tone by manipulating a joy stick.

12. An electronic musical instrument which simulates a sounding system of a non-electronic musical instrument, comprising:

performance information creating means for creating performance information;

a plurality of non-linear circuits each of which has a non-linear characteristic and converts an input signal corresponding to the performance information into an output signal according to the non-linear characteristic;

a plurality of linear circuits, each of which has a loop including a delay means for delaying a signal inputted thereto and a filer for filtering a signal inputted thereto, for receiving the output signal of the non-linear circuit so as to circulate the received output signal therein, wherein a musical tone waveform signal to be generated is picked up from the linear circuit; and an assignment circuit, coupled between the non-linear circuit and the linear circuit, for receiving an assignment signal so as to assign the non-linear circuit to a particular linear circuit in accordance with the received assignment signal.

* * * * *